US006536405B1

(12) United States Patent
Rieger et al.

(10) Patent No.: US 6,536,405 B1
(45) Date of Patent: Mar. 25, 2003

(54) FUEL INJECTION VALVE WITH INTEGRATED SPARK PLUG

(75) Inventors: Franz Rieger, Schwieberdingen (DE); Gernot Wuerfel, Vaihingen/Enz (DE); Stefan Kampmann, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/486,402

(22) PCT Filed: Apr. 1, 1999

(86) PCT No.: PCT/DE99/00984

§ 371 (c)(1),
(2), (4) Date: May 19, 2000

(87) PCT Pub. No.: WO00/00738

PCT Pub. Date: Jan. 6, 2000

(30) Foreign Application Priority Data

Jun. 27, 1998 (DE) ..... 198 28 849

(51) Int. Cl.[7] ..... F02M 57/06
(52) U.S. Cl. ..... 123/297; 313/120
(58) Field of Search ..... 123/297, 169 V; 313/120

(56) References Cited

U.S. PATENT DOCUMENTS

| | | | | |
|---|---|---|---|---|
| 1,310,970 A | * | 7/1919 | Stroud | 123/169 V |
| 2,795,214 A | | 6/1957 | Shook, II | 123/297 |
| 3,173,409 A | | 3/1965 | Warren | 123/169 R |
| 4,095,580 A | * | 6/1978 | Murray et al. | 123/297 |
| 4,736,718 A | * | 4/1988 | Linder | 123/297 |
| 5,497,744 A | * | 3/1996 | Nagaosa et al. | 123/297 |

FOREIGN PATENT DOCUMENTS

| | | | |
|---|---|---|---|
| DE | 11 78 644 | 9/1964 | |
| DE | 41 40 962 | 1/1993 | |
| EP | 0 632 198 A | 1/1995 | |
| EP | 0 661 446 | 7/1995 | |
| FR | 640927 * | 7/1928 | 123/297 |

* cited by examiner

*Primary Examiner*—Andrew M. Dolinar
(74) *Attorney, Agent, or Firm*—Kenyon & Kenyon

(57) ABSTRACT

A fuel injector having an integrated spark plug (1) for injecting fuel directly into a combustion chamber (72) of an internal combustion engine and for igniting the fuel that is injected into the combustion chamber (72) has a valve body (7), which, together with a valve-closure member (10), forms a sealing seat. Disposed contiguously to the sealing seat is a discharge orifice (12), which discharges at a valve-body (7) end face (73) facing the combustion chamber (72). Provision is also made for a housing body (2) that is insulated from the valve body (7), and for an ignition electrode (70*a*) that is connected to the housing body (2). In this context, a spark arc-over is produced between the valve body (7) and the ignition electrode (70*a*). The ignition electrode (70*a*) and the valve body (7) are formed in such a way that the spark arc-over takes place between the end face (73) of the valve body (7) facing the combustion chamber (72) and the ignition electrode (70*a*). In the vicinity of the discharge orifice (12), the ignition electrode (70*a*) has an edge (74) in order to reproducibly define the position of the spark arc-over at the end face (73) of the valve body (7) with respect to the position of the discharge orifice (12).

1 Claim, 7 Drawing Sheets

FUEL INJECTION VALVE WITH INTEGRATED SPARK PLUG

FIELD OF THE INVENTION

The present invention relates to a fuel injector having an integrated spark plug.

BACKGROUND INFORMATION

European Published Patent Application No. 0 661 446 concerns a fuel injector having an integrated spark plug. The fuel injector having an integrated spark plug is used to inject fuel directly into the combustion chamber of internal combustion engine and to ignite the fuel that is injected into the combustion chamber. Installation space at the cylinder head of the internal combustion engine can be economized through the compact integration of a spark plug in a fuel injector. The known fuel injector having an integrated spark plug includes a valve body, which, together with a valve-closure member actuatable by a valve needle, forms a sealing seat. Contiguous to the sealing seat is a spray orifice, which discharges at a valve-body end face facing the combustion chamber. The valve body is insulated by a ceramic insulating body from a housing body that is able to be screwed into the cylinder head of the internal combustion engine. Disposed on the housing body is a ground electrode for producing a counter voltage to the high voltage being applied to the valve body. When the valve body is loaded with sufficiently high voltage, a spark arcing-over takes place between the valve body and the ground electrode connected to the housing body.

It is believed that one problem with such a fuel injector having an integrated spark plug, however, is that the position of the spark arc-over is not defined with respect to the fuel jet spray-discharged from the spray orifice, since the spark arc-over can take place at virtually any point in the lateral region of a valve-body projection. The so-called root of the fuel jet spray-discharged from the spray orifice cannot be ignited with the level of certainty required for this known type of construction. However, a reliable and precisely timed fuel-jet ignition is absolutely essential for reducing pollutant emissions. In addition, coking and sooting can constantly progress at the fuel-jet discharge orifice, affecting the spray-discharged jet form.

SUMMARY OF THE INVENTION

In contrast, it is believed that one advantage of the fuel injector having the integrated spark plug of an exemplary embodiment of the present invention is that the spark arc-over position is able to be reproducibly and unambiguously defined with respect to the spray-orifice position. It is also believed that this ensures a reliable ignition of the spray-discharged fuel jet. The spark arc-over position and, thus, the ignition point can be placed in the region of the spray-discharged fuel jet having the least significant, cyclical jet fluctuations. Therefore, the instant of fuel-jet ignition exhibits extremely small fluctuations from injection cycle to injection cycle. Positioning the spark arc-over (that is, and change "orifice" to orifice) the ignition point in the vicinity of the spray orifice counteracts any sooting and coking effect and, thus, acts in opposition to any changes in the jet geometry resulting therefrom.

The edge for defining the spark arc-over position can either be provided at the valve-body end face or at the ignition electrodes. The edge at the valve-body end face can be formed by a protuberance or indentation. In this context, it is advantageous that the valve body have a rounded flank region for specifically targeting the air flow to the ignition point. One or a plurality of pin-shaped ignition electrodes can be secured to the housing body, inclined at a predefined angle toward the valve-body end face. In this context, one edge of the ignition electrodes constitutes the point having the smallest distance to the valve-body end face and, thus, defines the ignition point. When the edge defining the ignition point is formed at the valve-body end face, a simple wire spanning the valve-body end face can also be used as an ignition electrode, which is an especially cost-effective design.

The ignition electrode can quite advantageously have a ring-shaped design, including an opening for the fuel jet spray-discharged.from the spray orifice. In this context, the edge defining the ignition point is formed at the opening of the annular ignition electrode. To avoid hindering the fuel jet, it is advantageous for the opening of the annular ignition electrode to widen conically in the spray-discharge direction of the fuel jet, with the opening angle of the ignition electrode being advantageously adapted to the opening angle of the fuel jet. Designing the mount fixture for the ignition electrode with radially distributed bar-type projections and with pins, arranged radially with respect to the projections, ensures an adequate, radial, oncoming combustion-air flow and reinforces reliable fuel-jet ignition.

DETAILED DESCRIPTION

Description of the Exemplary Embodiments

Figure 1:
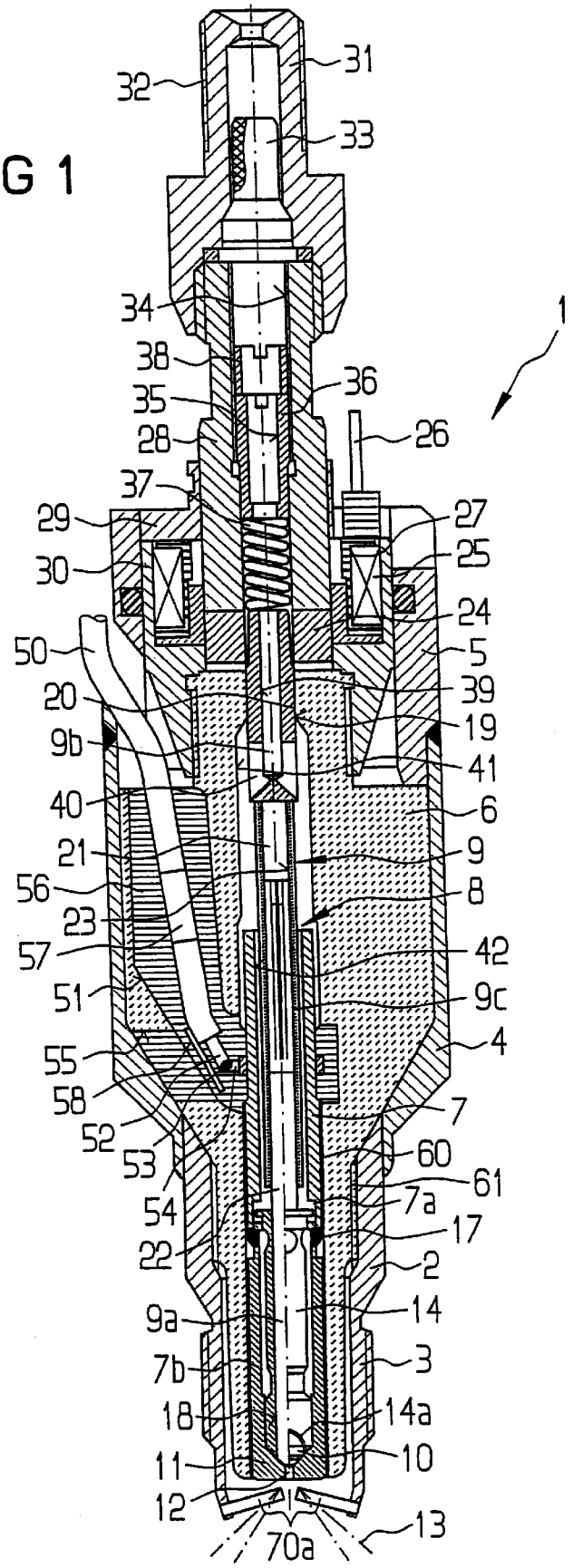
FIG. 1 shows a cross-section through a fuel injector having an integrated spark plug in accordance with a first exemplary embodiment.

FIG. 1 shows a fuel injector having an integrated spark plug for injecting fuel directly into a combustion chamber of a mixture-compressing internal combustion engine having externally supplied ignition, and for igniting the fuel injected into the combustion chamber in accordance with one exemplary embodiment of the present invention.

The fuel injector, 1, having an integrated spark plug, has a first housing body 2, which is able to be screwed by a thread 3 into a receiving bore of a cylinder head (not shown in FIG. 1), and has a second housing body 4, and a third housing body 5. The metallic housing formed by housing bodies 2, 4, 5 surrounds an insulating body 6, which, in turn, at least partially radially surrounds on the outside a valve body 7, a swirl baffle 14, and a valve needle 9 extending out from the inside of swirl baffle 14 over inflow-side end 8 of valve body 7. Joined to valve needle 9 is a spray-discharge-side, conically designed valve-closure member 10, which, together with the inner, conical valve-seat surface at the spray-discharge-side end 11 of valve body 7, forms a sealing seat. In the exemplary embodiment, valve needle 9 and valve-closure member 10 are formed in one piece. By lifting off of valve-seat surface of valve body 7, valve-closure member 10 releases a discharge orifice 12 formed in valve body 7, so that a conical fuel jet 13 is spray-discharged. To improve the peripheral fuel distribution, the exemplary embodiment provides for a swirl groove 14*a* in swirl baffle 14, a plurality of swirl grooves 14*a* also being possible.

Provided on first housing body 2 are first ignition electrodes 70*a* for producing an ignition spark. In this context, ignition electrodes 70*a* conduct ground potential, while valve body 7 is able to receive a high-voltage potential. The lengths of ignition electrodes 70*a* are to be adapted to the angle and shape of fuel jet 13. In this context, ignition electrodes 70*a* can either dip into fuel jet 13, or fuel jet 13 can stream past ignition electrodes 70*a* at a slight distance, without ignition electrodes 70*a* being wetted by the fuel. Also conceivable is that ignition electrodes 70*a* dip into gaps between single jets produced by discharge orifice 12 or by a plurality of spray orifices.

Valve body 7 is preferably formed in two parts, of a first partial body 7*a* and of a second partial body 7*b*, which are welded together at a weld 17.

In the exemplary embodiment, the articulated structure of valve needle 9 is such that it has a first metallic, spray-discharge-side guide section 9*a*, a second metallic, inflow-side guide section 9*b*, and, in the exemplary embodiment, a sleeve-shaped ceramic insulating section 9*c*. First guide section 9*a* is guided in swirl baffle 14. In the exemplary embodiment, the guidance is carried out through cylinder-shaped lateral surface 18 of valve-closure member 10, formed in one piece with first guide section 9*a*. A second guidance of valve needle 9 is carried out using second guide section 9*b* in insulating body 6. For this, lateral surface 19 of second guide section 9*b* cooperates with a bore 20 in insulating body 6. Guide sections 9*a* and 9*b* used for the guidance are designed as metallic components and can be fabricated with the manufacturing precision required for the guidance. Because the surface roughness of the metallic components is negligible, there is only an insignificant coefficient of friction at the guideways. On the other hand, insulating section 9*c* can be manufactured as a ceramic part. Since insulating section 9*c* is not used for guidance of valve needle 9, only minimal requirements of dimensional accuracy and surface roughness have to be met. Therefore, there is no need to rework the ceramic part.

Guide sections 9*a* and 9*b* are not only connected to insulating section 9*c* with an interference fit but also with form locking. In the depicted exemplary embodiment, guide sections 9*a* and 9*b* each have a pin 21, 22, that is introduced into a recess of insulating section 9*c* designed as a bore 23. The connection between pins 21 and 22 of guide sections 9*a* and 9*b* is preferably established by friction locking, adhesive bonding, or by shrink-fitting.

Insulating section 9*c* preferably has a sleeve-shaped design. Since material is economized as compared to a solid-body design, there is also a reduction in weight, leading to shorter switching (or operating) times for fuel injector 1.

Second guide section 9*b* is connected to an armature 24, which cooperates with a solenoid coil 25 for electromagnetically actuating valve-closure member 10. A connecting cable 26 supplies current to solenoid coil 25. A coil brace 27 accommodates solenoid coil 25. A sleeve-shaped core 28 at least partially penetrates solenoid coil 25 and is spaced apart from armature 24 by a gap (not discernible in the Figure) in the closed position of fuel injector 1. The magnetic flow circuit is closed by ferromagnetic components 29 and 30. Fuel flows across a fuel intake connection 31, which is able to be connected by a thread 32 to a fuel distributor (not shown), into the fuel injector having an integrated spark plug 1. The fuel then flows through a fuel filter 33 and, subsequently, into a longitudinal bore 34 of core 28. Provided in a longitudinal bore 34 is an adjusting sleeve 36 having a hollow bore 35, into which longitudinal bore 34 of core 28 is able to be screwed into place. Adjusting sleeve 36 is used for adjusting the prestressing of a restoring spring 37, which acts upon armature 24 in the closing direction. The locking sleeve 38 secures the adjustment of adjusting sleeve 36.

The fuel continues to flow through a longitudinal bore 39 in second guide section 9*b* of valve needle 9, and enters at an axial recess 40 into a cavity 41 of insulating body 6. From there, the fuel flows into a longitudinal bore 42 of valve body 7, into which valve needle 9 also extends, and ultimately reaches the described swirl groove 14*a* at the outer periphery of swirl baffle 14.

As already described, ignition electrodes 70*a* connected to housing body 2 conduct ground potential, while valve body 7 is able to receive a high-voltage potential to produce ignition sparks. A high-voltage cable 50, which leads via a side, pocket-like recess 51 into insulating body 6, is used to supply the high voltage. The bared end 52 of high-voltage cable 50 is soldered or welded to a soldering point or weld 53 using a contact clip 54. Contact clip 54 embraces valve body 7 and establishes a secure, electrically conductive contact between stripped end 52 of high-voltage cable 50 and valve body 7. Soldering point or weld 53 are made more accessible by providing insulating body 6 with a radial bore 55, through which a soldering or welding tool can be introduced. Once this soldering or weld connection is produced, the pocket-like recess 51 is sealed by an electrically insulating setting compound 56. In this context, a burn-off resistor 57, integrated in high-voltage cable 50, can also be sealed into setting compound 56. To better insulate soldering point or weld 53, a high-voltage-resistant film 58 can be placed in pocket-like recess 51 of insulating body 6 and likewise be sealed by setting compound 56. Silicon, for example, is suited as a setting compound 56.

Insulating body 6 and valve body 7 can be screw-coupled to one another at a thread 60. In addition, insulating body 6 can be screw-coupled to housing body 2 at a further thread 61. Screw threads 60 and 61 are preferably secured using a suitable adhesive. Insulating body 6 can be manufactured inexpensively as an injection-molded ceramic part. Valve body 7 and insulating body 6 can be screw-coupled and adhesively bonded with the aid of a mounting mandrel to compensate for any alignment errors in the guidance of valve needles 9.

The close proximity of burn-off resistor 57 to ignition electrodes 70*a* reduces the burn-off at ignition electrodes 7*a* and, in spite of an elevated electrical capacitance, permits the fuel injector having integrated spark plug 1 to be fully encased by metallic housing bodies 2, 4 and 5.

Figure 2:
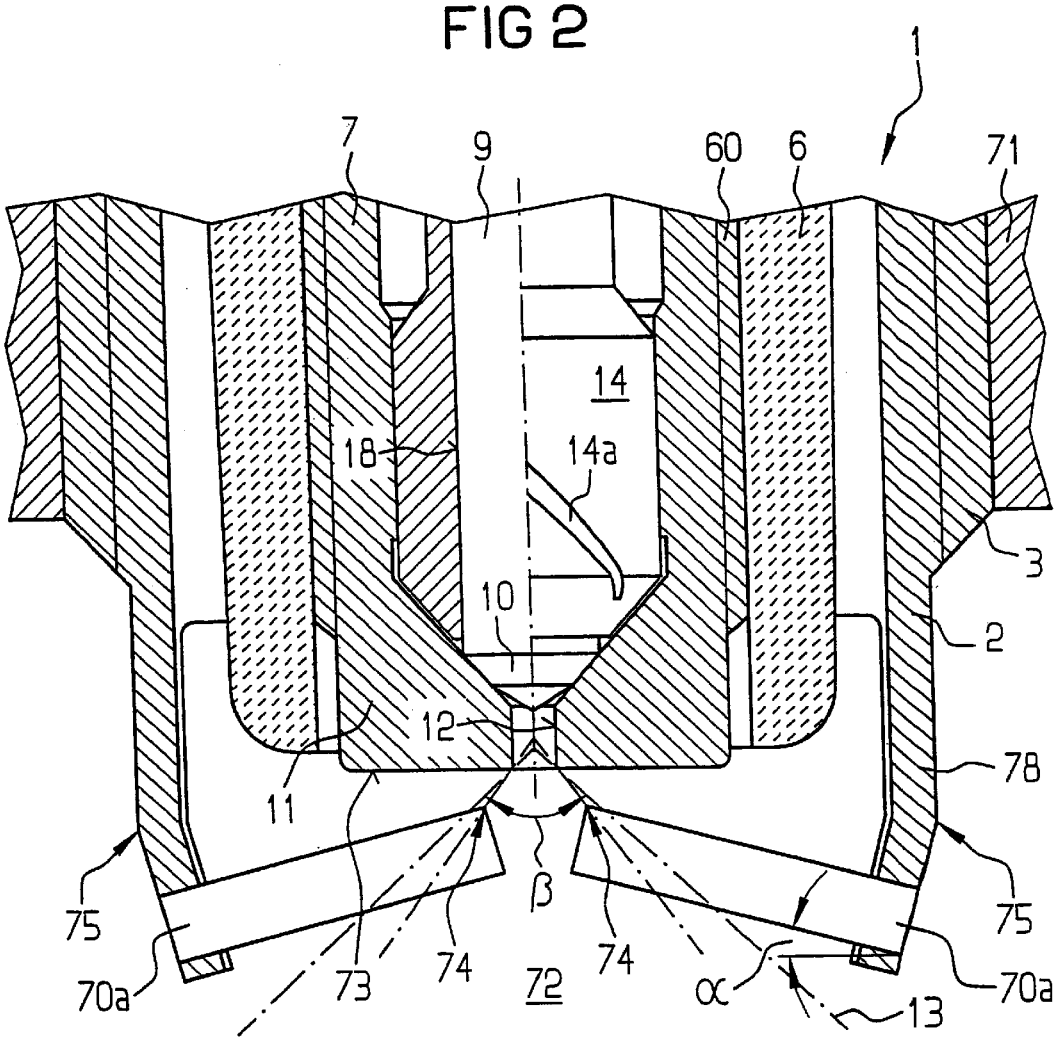
FIG. 2 shows an enlarged view of the spray-discharge-side end region of the fuel injector of FIG. 1.

FIG. 2 shows an enlarged representation of the spray-discharge-side end region of the first exemplary embodiment shown in FIG. 1 of the fuel injector, having an integrated spark plug 1. Next to valve-closure member 10 and discharge orifice 12 designed as a cylinder bore, are ignition electrodes 70*a*. In of FIG. 2, the fuel injector having an integrated spark plug 1 is screwed into a cylinder head 71 of an internal combustion engine, so that ignition electrodes 70*a* project into a combustion chamber 72 of the internal combustion engine.

A plurality of projections 78 of housing body 2 are used to attach ignition electrodes 70*a*, designed in the exemplary embodiment of FIGS. 1 and 2 with a pin-, e.g., cylinder-shape. In this context, projections 78 of housing body 2 are arranged over the periphery of housing body 2, offset from one another, relatively large interspaces being formed between the individual projections 78, to enable an unobstructed oncoming flow of combustion air to the outlet of discharge orifice 12 at end face 73 of valve body 7 facing combustion chamber 72. Arranged at each projection 78 of housing body 2 being used as a mount fixture, is an ignition electrode 70*a*, which, for example, is welded or screw-coupled to its associated projection 78. Ignition electrodes 70*a* are each tilted with respect to the plane of end face 73 of valve body 7 by a predefined angle of inclination toward end face 73 of valve body 7. In this context, disposed opposite end face 73 of valve body 7 in each case is an edge 74 of pin-shaped ignition electrodes 70*a*. The position of edges 74 defines the location of the shortest distance between ignition electrodes 70*a* and end face 73 of valve body 7 and, thus, establishes the point of ignition. The edge-shaped formation produces an elevated electrical field strength at this location, giving rise to the plasma discharging of the ignition spark. Therefore, the point of ignition defined by edges 74 is reproducible from injection cycle to injection cycle. The most favorable position of the point of ignition can be optimized in experimental tests and is located in the area of the so-called jet root of fuel jet 13 spray-discharged from discharge orifice 12. By varying the length and angle of inclination of ignition electrodes 70*a*, the position of edges 74 can be adapted to opening angle β of fuel jet 13 already spray-discharged from discharge orifice 12. From a standpoint of production engineering, the distance of edges 74 of ignition electrodes 70*a* from end face 73 of valve body 7 can be precisely adjusted by bending projections 78 at their knee point 75.

Figure 3:
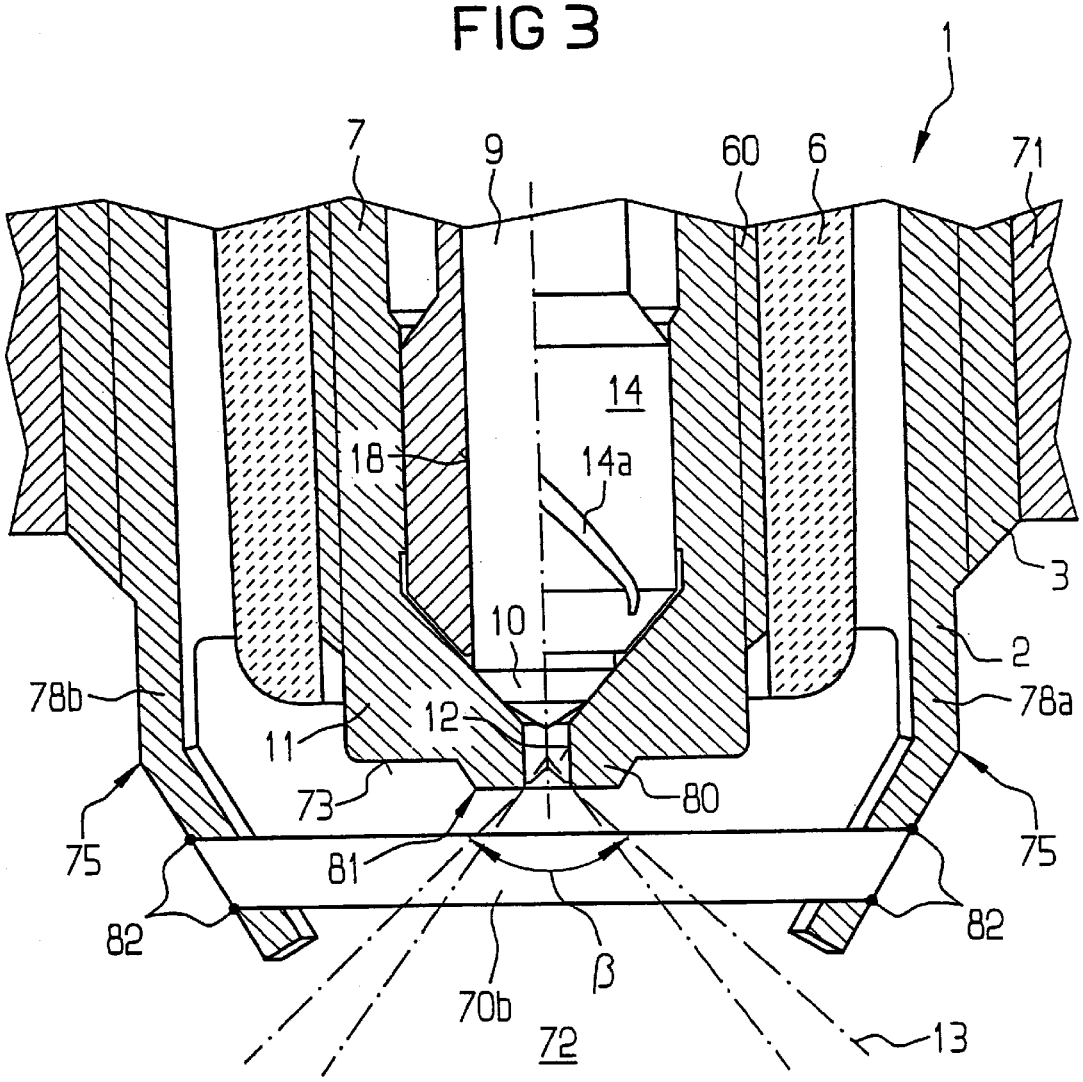
FIG. 3 shows a cross-section through the spray-discharge-side end region of a fuel injector having an integrated spark plug according to a second exemplary embodiment.

FIG. 3 shows a section through the spray-discharge-side end region of a fuel injector having an integrated spark plug 1 in accordance with a second exemplary embodiment of the present invention. Identical reference numerals are used for those elements that have already been described.

Here, a difference from the exemplary embodiment described on the basis of FIGS. 1 and 2 is that the edge for defining the position of the spark arc-over and, thus, the point of ignition, is not formed at ignition electrode 70, but rather at end face 73 of valve body 7. In this context, end face 73 of valve body 7 has a protuberance 80 with a peripheral edge 81. The application of a high voltage at valve body 7 produces an elevated electrical field strength at edge 81, triggering plasma discharging of the ignition spark. The position of the point of ignition can be precisely set in relation to the position of discharge orifice 12 by suitably dimensionally sizing the diameter of protuberance 80. In this exemplary embodiment, ignition electrode 70*b*, which conducts ground potential, can be formed by a simple wire, which is run between a first projection 78*a* of housing body 2 and a second projection 78*b* of housing body 2 and which can be fixed by welds 82. The wire-shaped ignition electrode 70*b* is a refinement that entails very little manufacturing outlay. Instead of a protuberance 80 at end face 73 of valve body 7, an indentation can also be provided, at whose delimitation is likewise formed an edge for increasing the electrical field strength in point-by-point fashion.

Figure 4:
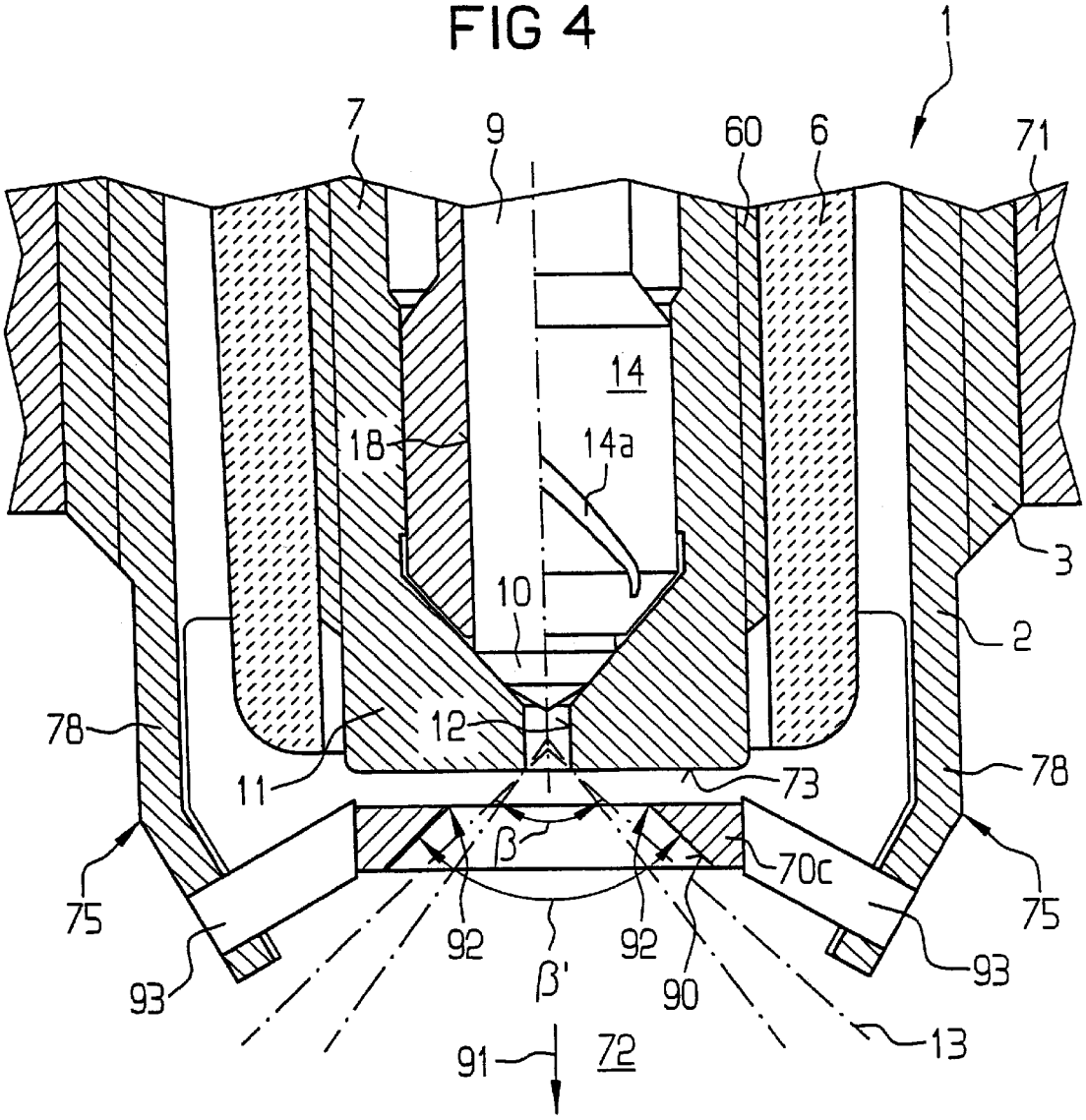
FIG. 4 shows a cross-section through the spray-discharge-side end region of a fuel injector having an integrated spark plug according to a third exemplary embodiment.

FIG. 4 illustrates a section through the spray-discharge-side end region of a third exemplary embodiment of a fuel injector having an integrated spark plug 1. Here, as well, identical reference numerals denote already described elements.

In contrast to the exemplary embodiments already described, in the exemplary embodiment depicted in FIG. 4, ignition electrode 70*c* has an annular shape and has an opening 90 for fuel jet 13 spray-discharged from discharge orifice 12. Opening 90 of annular ignition electrode 70*c* is preferably designed with a conical inner surface, and it widens in spray-discharge direction 91 of fuel jet 13. Opening angle β' of opening 90 of annular ignition electrode 70*c* is preferably adapted to opening angle β of fuel jet 13. Preferably, opening angle β' of opening 90 conforms with opening angle β of fuel jet 13. At the inner end opposing end face 73 of valve body 7, opening 90 has an acute-angled edge 92, which, in this exemplary embodiment, defines the point of ignition. Annular ignition electrode 70*c* is secured via connecting pins 93 to projections 78 of housing body 2. Projections 78 are radially distributed over the periphery of housing body 2. For example, three or four such projections 78 are provided. Assigned to each projection 78 is a connecting pin 93. Projections 78 and connecting pins 93 have a relatively narrow design, so that, between them, relatively large gaps remain, through which the combustion air can flow unimpeded to the outlet of discharge orifice 12 and to the point of ignition defined by circumferential edge 92.

An unobstructed oncoming flow of combustion air is essential for fuel jet 13 to be reliably ignited and to ensure minimal sooting and coking at the outlet of discharge orifice 12.

Figure 5:
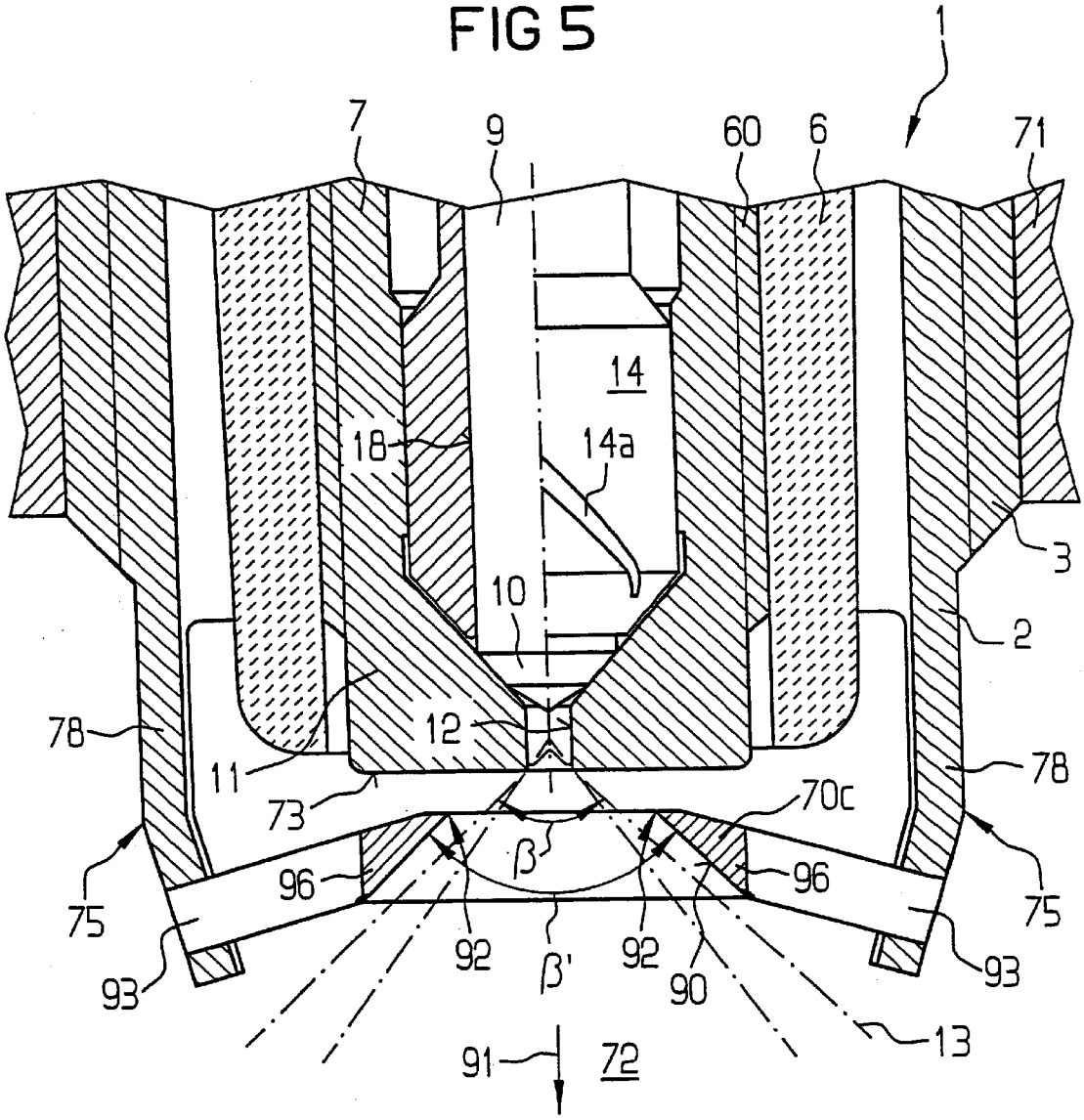
FIG. 5 shows a cross-section through the spray-discharge-side end region of a fuel injector having an integrated spark plug according to a fourth exemplary embodiment.

FIG. 5 shows a section through the spray-discharge-side end of a fuel injector having an integrated spark plug 1 in accordance with a fourth exemplary embodiment. Identical reference numerals again denote already described elements. FIG. 5 shows that the ignition electrode 70*c* has a chamfered section 96, with which connecting pins 93 join up in alignment. In this manner, edges are avoided at the transition between pins 93 and annular ignition electrode 70*c*, so that at these locations, no elevated field strength arises which could lead to a parasitic ignition point.

Figure 6:
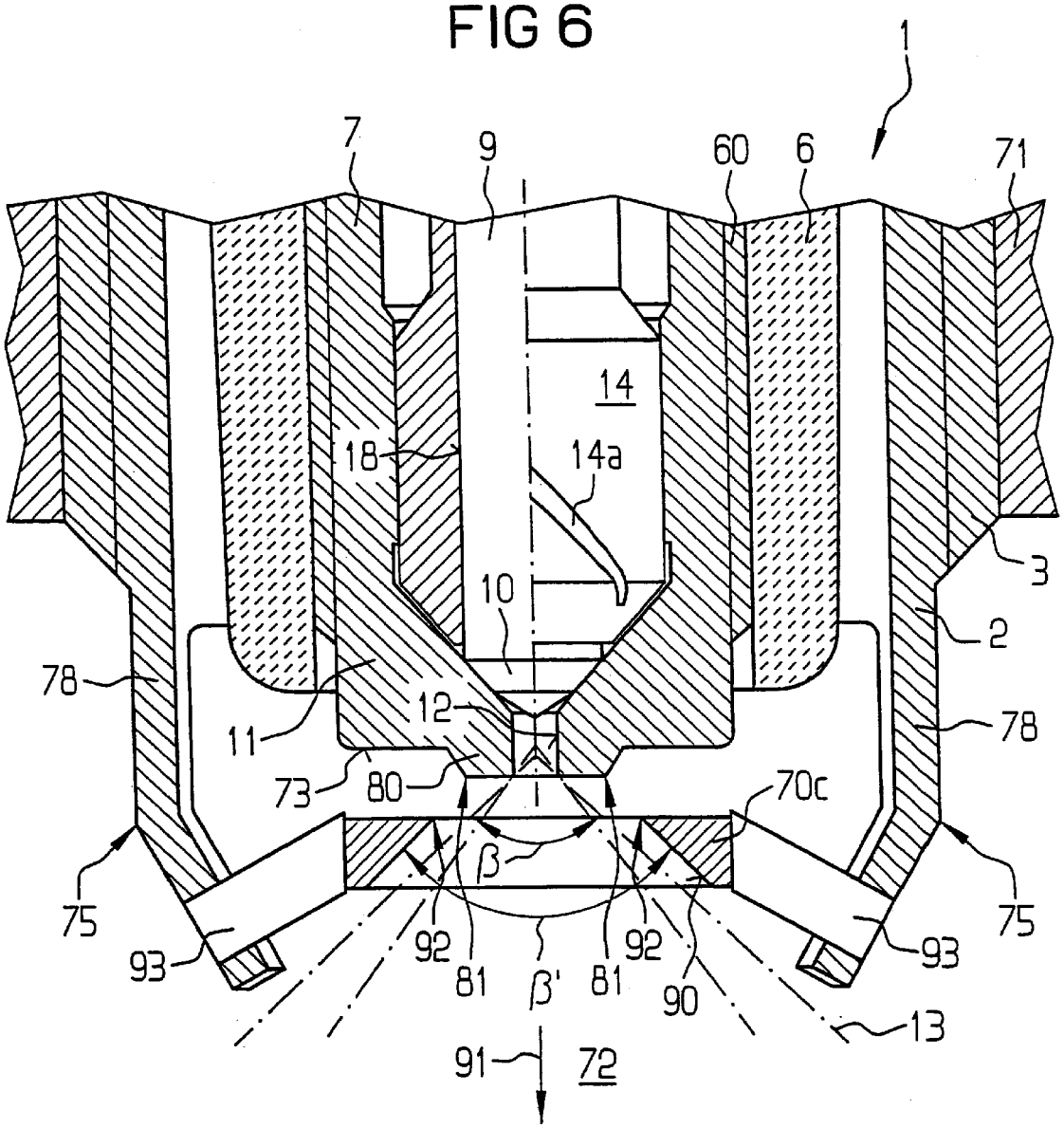
FIG. 6 shows a cross-section through the spray-discharge-side end region of a fuel injector having an integrated spark plug according to a fifth exemplary embodiment.

FIG. 6 shows a section through the spray-discharge-side end of a fuel injector having integrated spark plug 1 in accordance with a fifth exemplary embodiment. Here as well, already described elements are designated by same reference numerals. The exemplary embodiment described in FIG. 6 represents a combination of the exemplary embodiments illustrated in FIGS. 3 and 4. In this context, an annular electrode 70*c* is provided, whose opening 90 has an edge 92 at the end opposing end face 73 of valve body 7. End face 73 of valve body 7 has a protuberance 80 with a peripheral edge 81. Peripheral edge 81 of protuberance 80 is located in the vicinity of peripheral edge 92 of annular ignition electrode 70*c*. The point of ignition is situated between peripheral edges 92 and 81, since at this location, valve body 7 and ignition electrode 70*c* have the smallest distance from one another, and since, an especially high electrical field strength arises at this location because of edges 81 and 92.

Figure 7:
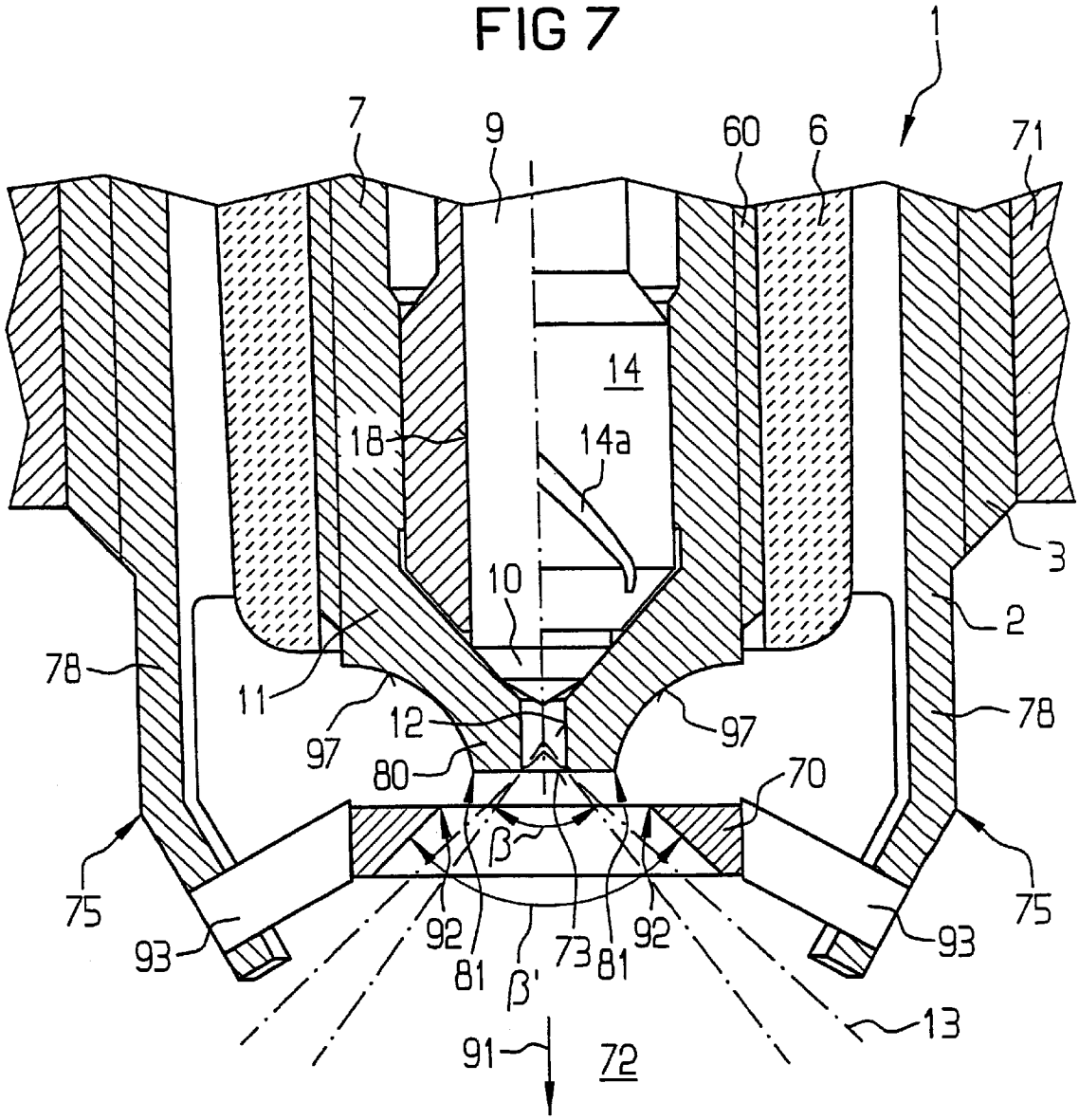
FIG. 7 shows a cross-section through the spray-discharge-side end region of a fuel injector having an integrated spark plug according to a sixth exemplary embodiment.

FIG. 7 shows a section through the spray-discharge-side end region of a fuel injector having integrated spark plug 1 in accordance with a sixth exemplary embodiment of the present invention. Here as well, already described elements are designated by the same reference numerals. The exemplary embodiment described in FIG. 7 corresponds substantially to the numerals. In the exemplary embodiment of FIG. 7, a form. This directs the laterally oncoming combustion air to fuel jet 13 and to the point of ignition defined by peripheral edges 81 and 92. This results, therefore, in a particularly good inflow geometry for the combustion air, ensuring reliable ignition of fuel jet 13 and a low-emission combustion. Sooting and coking at the outlet of discharge orifice 12 are counteracted.

It is believed that in comparison with known long and thin finger electrodes, the form and shape of ignition electrodes 70*a*–70*c* in the exemplary embodiments described above, make it possible to avoid an unintentional auto-ignition. In addition, ignition electrodes 70*a* through 70*c* designed in accordance with an exemplary embodiment of the present invention feature an increased mechanical stability and a prolonged service life. The geometry of ignition electrodes 70*a* through 70*c* and of valve body 7 makes it possible to achieve a constant fuel/air mixture having a lambda of between 0.6 and 1.0 at the point of ignition. The point of ignition lies within the range of the smallest cyclical fluctuations of the fuel jet. Any impurities deposited on end face 73 of valve body 7 are burned off by the ignition sparks, which provides a self-cleaning effect.

What is claimed is:

1. A fuel injector associated with an integrated spark plug for injecting a fuel directly into a combustion chamber of an internal combustion engine and for igniting the fuel that is injected into the combustion chamber, comprising:

a valve-closure member;

a valve body forming with the valve-closure member a sealing seat to which a discharge orifice that discharges at a level end face of the valve body facing the combustion chamber is contiguously disposed;

a housing body insulated from the valve body; and a plurality of pin-shaped ignition electrodes provided at the housing body to produce a spark arc-over between the valve body and the plurality of pin-shaped ignition electrodes;

wherein the plurality of pin-shaped ignition electrodes and the valve body are formed so that a spark arc-over occurs between the level end face of the valve body and the plurality of pin-shaped ignition electrodes;

wherein at least one of the level end face of the valve body and the plurality of pin-shaped ignition electrodes include an edge in a vicinity of the discharge orifice to reproducibly define a position of the spark arc-over at the level end face of the valve body with respect to a position of the discharge orifice; and wherein the housing body includes a mount fixture that projects over the level end face of the valve body and to which the plurality of pin-shaped ignition electrodes are secured so as to be tilted at a predefined inclination angle toward the level end face of the valve body; and wherein one edge of each of the plurality of pin-shaped ignition electrodes opposes the level end face of the valve body.

* * * * *

UNITED STATES PATENT AND TRADEMARK OFFICE

CERTIFICATE OF CORRECTION

PATENT NO. : 6,536,405 B1
DATED : March 25, 2003
INVENTOR(S) : Rieger et al.

It is certified that error appears in the above-identified patent and that said Letters Patent is hereby corrected as shown below:

Column 6,
Line 42, please delete "the ignition electrode" and insert -- the annular ignition electrode --
Line 61, please delete "since at this" and insert -- since, at this --
Line 63, please delete "since," and insert -- since --

Column 7,
Lines 3-6, please delete "The exemplary embodiment described in FIG. 7 corresponds substantially to the numerals. In the exemplary embodiment of FIG. 7, a form." and insert -- In the exemplary embodiment of FIG. 7, a flank region 97 of protuberance 80 of end face 73 of valve body 7 is rounded off in a concave from. --

Signed and Sealed this

Twelfth Day of October, 2004

JON W. DUDAS
*Director of the United States Patent and Trademark Office*